US005287088A

United States Patent [19]

Sills

[11] Patent Number: 5,287,088

[45] Date of Patent: Feb. 15, 1994

[54] METHOD AND APPARATUS FOR MODIFYING SYNTHESIZED SOUND SIGNALS

[76] Inventor: Richard R. Sills, 1085 Park Ave., New York, N.Y. 10128

[21] Appl. No.: 376,335

[22] Filed: Jul. 6, 1989

[51] Int. Cl.[5] ..... G09G 5/00; G09G 5/40; G09G 5/34

[52] U.S. Cl. ..... 345/112; 345/116; 345/126

[58] Field of Search ..... 340/700, 715, 722, 815.11, 340/825.19, 890.16, 524, 525; 84/464 R, 464 A; 381/56, 61, 62, 63, 98, 101, 102, 103

[56] References Cited

U.S. PATENT DOCUMENTS

| | | | |
|---|---|---|---|
| 4,039,956 | 8/1977 | Shimanek et al. | 340/722 |
| 4,185,276 | 1/1980 | Benson | 340/815.11 |
| 4,440,059 | 4/1984 | Hunter | 340/815.11 |
| 4,577,188 | 3/1986 | Inami et al. | 340/722 |
| 4,614,942 | 9/1986 | Molinaro | 340/815.11 |
| 4,768,086 | 8/1988 | Paist | 340/815.11 |
| 4,802,106 | 1/1989 | Saito et al. | 340/722 |
| 4,847,785 | 7/1989 | Stephens | 340/722 |
| 4,868,869 | 9/1989 | Kramer | 381/61 |
| 4,937,037 | 6/1990 | Griffiths et al. | 340/722 |

OTHER PUBLICATIONS

Robert Rich: "Digidesign Turbosynth Synthesis Software"; MT Sep. 1988; pp. 72–75.

*Primary Examiner*—Ulysses Weldon
*Assistant Examiner*—M. Fatahiyar
*Attorney, Agent, or Firm*—Jordan and Hamburg

[57] ABSTRACT

An audio sound modification system for modifying the output sound signals of a sound synthesizer comprises a microcomputer connected to receive signals from the synthesizer and to output modified sound signals. The microcomputer comprises a display device, and displays an image on the display device that has motion, color and shade characteristics. An operator input is also provided. The microcomputer is responsive to first, second and third different input signals from the operator input for modifying first, second and third different characteristics of the received signals and for modifying the motion, color and shade characteristics of the image, respectively.

16 Claims, 2 Drawing Sheets

METHOD AND APPARATUS FOR MODIFYING SYNTHESIZED SOUND SIGNALS

BACKGROUND OF THE INVENTION

This invention is directed to audio signal generation, and relates more in particular to a method and apparatus for modifying synthesized sound signals.

Synthesizers are well known for the generation of sound signal, such as music, sound effects, etc. Such devices are generally quite large and expensive, however, and have a finite capacity for varying the sound signals. For example, it may be readily possible for the devices to simulate specific instruments, but limited capacity is generally provided for further modifying the signals as desired by an operator.

SUMMARY OF THE INVENTION

The present invention is therefore directed to the provision of an improved method and apparatus that readily enables almost limitless variation of the output signals of a sound synthesizer in a simple and economical manner, and that is relatively inexpensive.

Briefly stated, the invention comprises an audio sound modification system for modifying the output sound signals of a sound synthesizer, comprising a microcomputer connected to receive signals from the synthesizer and output modified sound signals. The microcomputer comprises a display device, means for displaying an image on the display device that has motion, color and shade characteristics, and an operator input means. The microcomputer further comprises means responsive to first, second and third different input signals from the operator input means for modifying first, second and third different characteristics of the received signals and for modifying the motion, color and shade characteristics of the image, respectively.

The image may be a rotating circle of colored dots, whereby the means for modifying the motion, color and shade characteristics comprises means for adjusting the speed of rotation of the circle, the color of the dots, and the shade of the dots.

The means for modifying the input signals may modify the harmonic content, harmonic amplitude and/or the ratios of the harmonics of the signals.

In accordance with a further feature of the invention, an audio sound signal modification system comprises an input for receiving an audio sound signal, a computer, an analog to digital converter for converting input signals to digital format for application to the computer, an output for outputting modified sound signals, a digital to analog converter for converting digital signals of the computer to analog signals for application to the output, and an operator signal input means and display device coupled to the computer. The computer comprises means for displaying on the display device a moving image, and first and second means responsive to first and second different signals input from the operator input means for modifying first and second different characteristics of signals input from the analog to digital converter for application to the digital to analog converter. The first and second means further comprises means for modifying the speed of movement of the image and another characteristic of the image, respectively, and for storing the respective signals. The computer further comprises means responsive to a third signal from the operator input means for saving the stored signals to a permanent storage medium.

The means for displaying a moving image may comprise means for displaying a rotating circle of colored dots. The means for modifying the speed of movement and another characteristic may comprise means for changing the speed of rotation of the dots and the color of the dots. The means for displaying may further comprise means for alphanumerically displaying the speed of rotation of the circle and the color of the dots. A third means responsive to third signals from the operator input means may be provided for modifying a third characteristic of signals input from the analog to digital converter for application to the digital to analog converter, and means for modifying a third characteristic of the image.

The means for modifying a third characteristic may comprise means for modifying the shade of at least one dot, and means for displaying the shade alphanumerically.

A method in accordance with the invention for modifying synthesized sound signals while providing an indication of the modification, comprises displaying an image having first, second and third characteristics, receiving first, second and third different operator signals, modifying first, second and third different characteristics of the sound signals respectively, and simultaneously modifying the first, second and third characteristics of the image, respectively.

In this method, the step of modifying the first, second and third characteristics of the image may comprise modifying the speed of motion of a portion of the image, the color of a portion of the image, and the shade of a portion of the image, respectively. The means for modifying first, second and third characteristic of the sound signals may comprise modifying the harmonic amplitude of the sound signals, the harmonic content of the sound signals, and/or the ratio of harmonic components of the sound signals.

BRIEF DESCRIPTION OF THE DRAWING

In order that the invention may be more clearly understood, it will now be disclosed in greater detail with reference to the accompanying drawing, wherein.

DETAILED DISCLOSURE OF THE INVENTION

Figure 1:
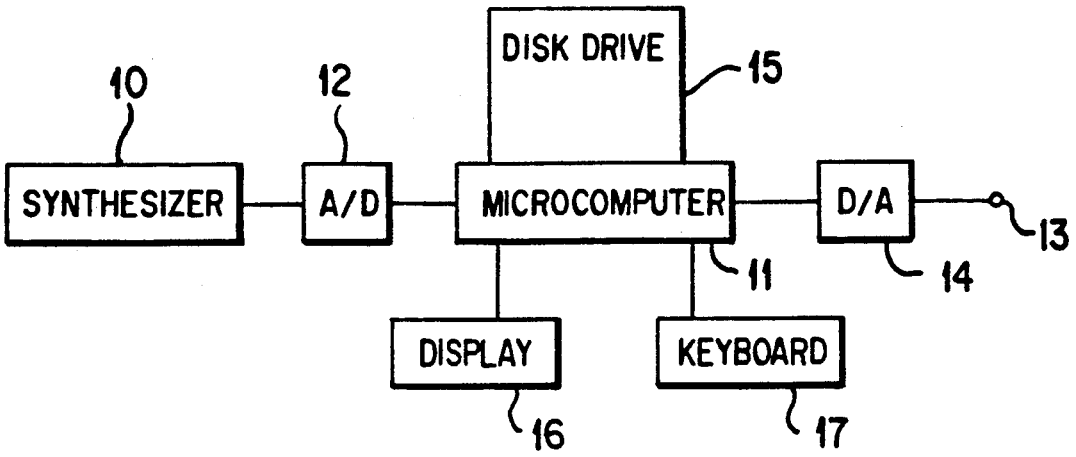
FIG. 1 is a block diagram of a system t hat may be employed in accordance with the invention.

Referring now to the drawings, and more in particular to FIG. 1, therein is illustrated a block diagram of equipment that may be employed in the practice of the invention.

As illustrated, the output of a sound synthesizer lo is applied to a microcomputer 11 by way of an analog to digital converter 12, and the output of the microcomputer 11, corresponding to modified sound signals, is applied to an output terminal 13 by way of a digital to analog converter 14. The microcomputer includes a device for transporting programs thereto for execution of the programs, as well as storing programs and other data, such as a disk drive 15, as well as a display 16 and a keyboard 17. The sound synthesizer 10 is a conventional commercially available unit, as is the microcomputer 11. The A/D and D/A converters are provided of course to enable the computer to process the signals, while still providing output signals that may be employed by a conventional sound reproduction device, such as a speaker (not shown).

As an introduction to the explanation of the invention, the program of the microcomputer, which may have been introduced therein from a disk in the disk drive 15, controls the modification of the signals input thereto from the synthesizer 10, in accordance with the operators instructions as received from the keyboard. It is of course apparent that other operator input devices may be used with or in place of the keyboard, such as a joy-stick or a mouse. In addition, the program provides a display of an image on the display device that aids the modifying the signals, as well as permits reproduction of effects that had previously been obtained. The program further permits storing of the characteristic modifications that had been set, in order to enable future modifications of the same type.

Figure 2:
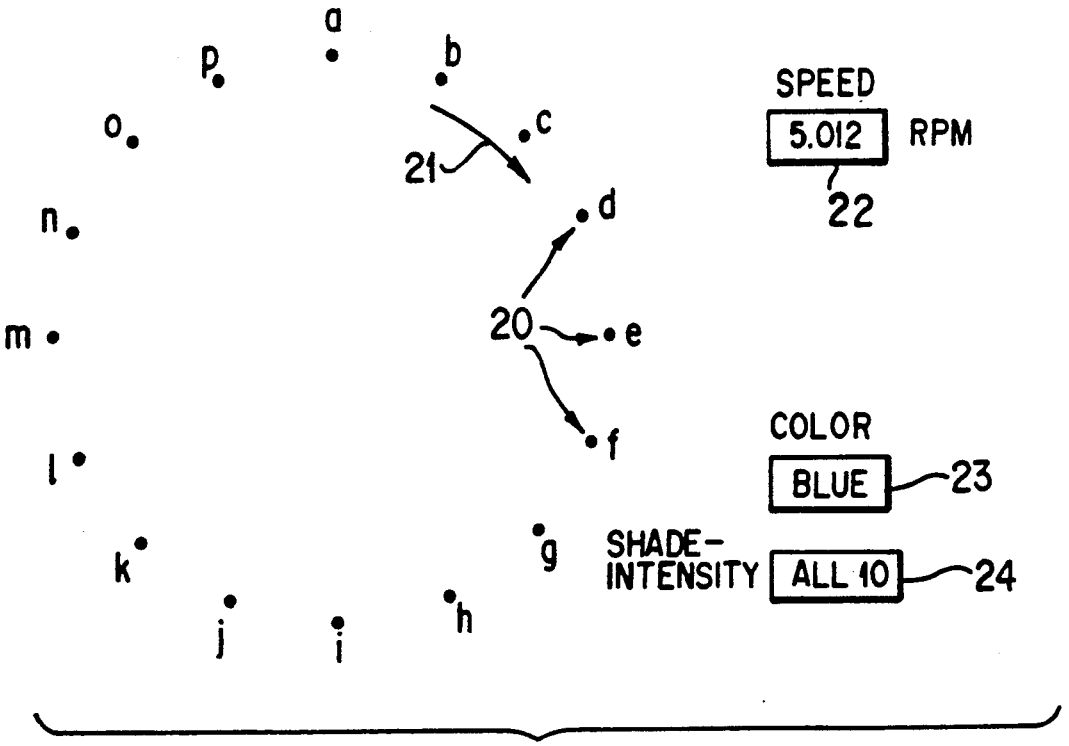
FIG. 2 is an illustration of a video display that may be presented with the apparatus of FIG. 1.

FIG. 2 illustrates one form of display that may be presented on the display device 16, in accordance with the invention. It has been found desirable to provide images that have motion, and adjustable color, in order to assist the operator in the modification of the sound. For this purpose, the program of the computer generates an image in the form of a circle 20 of dots a-p, that rotates in the direction of the arrow 21. The dots a-p have colors that depend upon the input from the operator, and the rate of rotation of the circle is also controlled by the operator. The number of dots displayed is arbitrary, and a greater or lesser number than illustrated may alternatively be employed. The absolute speed of revolution may be displayed alphanumerically at 22, and the color of the dots may be alphabetically indicated at 23. In addition, the operator may control the shade of the dots, a-p, the current shade being indicated at 24. For example, a dark color may be indicated by the numeral 10, and a light color may be indicated by the numeral 0.

It is of course apparent that other shapes and configurations than a circle may be employed for displaying a variable speed, and that other shaped regions than dots may be employed for displaying the selected colors. Provision may be made for employing different dots of several colors, if desired, with a suitable alphanumeric indication being also provided to indicate this choice.

Each characteristic displayed, e.g. motion, color, shade or other characteristic, corresponds to a given modification by the program of the input sound signals. The modification to the sound signals may constitute modifications of known characteristics, such as timbre, harmonic content, harmonic amplitude, ratios of harmonic components, etc. Accordingly, while the operator may not appreciate the physical cause of the changes that he has wrought in the modified sound, he will be able to relate the audible changes with the changes that have appeared in the image, so that the visible changes constitute an aid in the modification of the sound. In addition, by noting the settings that have been made to provide given effects the operator will be able to reproduce this effect at a later date. The modification that can be achieved in this manner is limitless, and it can be effected with relatively inexpensive equipment, such as the conventional microcomputers that are on the market today. It is of course apparent that changes in the output of the synthesizer may be made with the changes controlled by the operator in the program, in order to further increase the possible sound variations. Since the program may be on a floppy disk or the like, it is apparent that changes in the program to enhance the operation of the device may be readily effected.

Figure 3:
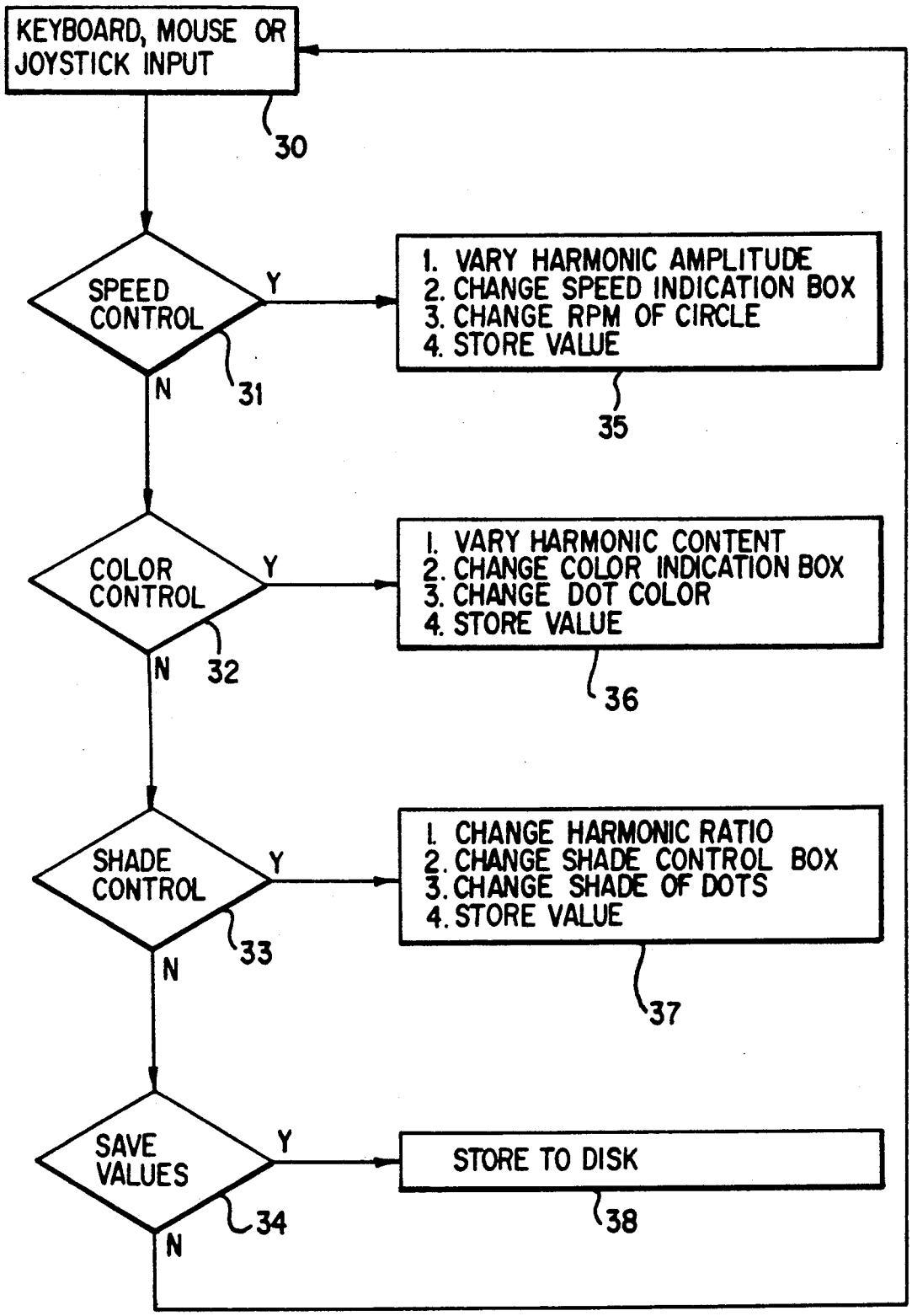
FIG. 3 is a flow diagram of a method in accordance with the invention.

FIG. 3 illustrates a flow diagram in accordance with one embodiment of the invention. As illustrated, the operator inputs a desired command, at block 30, for example from the keyboard, a joystick, or a mouse. The program tests these signals to determine if they relate graphically to speed of rotation of the circle (block 31), colors to be selected for the dots (block 32), shades of the colors of the dots (block 33) or a request to store data (block 34).

If the command relates to a change in speed of rotation of the circle, as indicated at block 35, the program varies a characteristic of the sound signals, e.g. the amplitude of the harmonics accompanying the signals. At this time the speed of rotation of the displayed circle is also changed, as is the alphanumeric indication thereof, with all of these changes being store in the event that the operator is pleased with the result and wishes to save them.

If the command relates to a change in color of the dots, as indicated at block 36, the program varies another characteristic of the sound signals, such as the harmonic content, and also changes the colors of the dots as commanded as well as the alphabetic indication of such changes. As above, the commanded changes are also stored.

If the command related to a change of shade of the color of the dots, as indicated at block 37, the program varies still another characteristic of the sound signals, such as the ratio of the harmonic components, changes the shade of the dots, and changes the alphanumeric indication of the shade. As before, these changes are also stored.

If the command requested the saving of the values, as indicated at block 38 the current stored values corresponding to speed, color and shade, are saved to a permanent storage device such as a disk.

In accordance with the invention, as a result of the interrelationships between the presentation on the screen of the display device, the operator input, and the sound received by the computer, the operator is aided in the modification of music or other sound, so that the modification can be stored and used again.

While the invention has been disclosed and described with reference to a single embodiment, it will be apparent that variations and modification may be made therein, and it is therefore intended in the following claims to cover each such variation and modification as falls within the true spirit and scope of the invention.

What is claimed is:

1. An audio sound modification system for modifying the output sound signals of a sound synthesizer, comprising a microcomputer connected to receive first sound signals from said synthesizer and to output modified sound signals, said microcomputer system comprising a display device, means for displaying an image on said display device that has motion, color and shade characteristics, and an operator input means, said microcomputer further comprising means responsive to first, second and third different input signals from said operator input means for modifying first, second and third different characteristics of said received first sound signals to produce said output modified sound signals, said microcomputer system further comprising means for modifying said motion, color and shade characteristics of said image, respectively, as a function of said first, second and third input signals from said operator input means independently of said first sound signals.

2. The audio sound modification system of claim 1 wherein said means displaying an image comprises means displaying a rotating circle of colored dots, and said means for modifying said motion, color and shade characteristics comprises means for adjusting the speed of rotation of said circle, the color of said dots, and the shade of said dots, respectively.

3. The audio sound modification system of claim 1 wherein said means for modifying said first sound signals comprises means for modifying harmonic content of said first sound signals.

4. The audio sound modification system of claim 1 wherein said means for modifying said first sound signals comprises means for modifying harmonic amplitude of said first sound signals.

5. The audio sound modification system of claim 1 wherein said means for modifying said first sound signals comprises means for modifying the ratios of different harmonics thereof.

6. An audio sound signal modification system comprising an input for receiving an audio input sound signal, a computer, an analog to digital converter for converting signals at said input to digital format for application to said computer, an output for outputting modified sound signals, a digital to analog converter for converting output signals of said computer to analog signals for application to said output, an operator input means and a display device, said computer comprising means for displaying on said display device a moving image, first and second means responsive to first and second different signals input from said operator input means for modifying first and second different characteristics of signals input from said analog to digital converter for application to said digital to analog converter, said first and second means further comprising means responsive to said first and second different signals input from said operator input means for modifying the speed of movement of said image and another characteristic of said image, respectively, independently of and not in a manner representative of said audio input sound signal and for storing the respective first and second signals, said computer further comprising means responsive to a third signal from said operator input means for saving said stored signals to a permanent storage medium.

7. The audio sound signal modification system of claim 6 wherein said means for displaying a moving image comprises means for displaying a rotating circle of colored dots, said means for modifying the speed of movement and another characteristic comprises means for changing the speed of rotation of said dots and the color of said dots.

8. The audio sound signal modification system of claim 7 wherein said means for displaying further comprises means for alphanumerically displaying the speed of rotation of said circle and the color of said dots.

9. The audio sound signal modification system of claim 6 further comprising third means responsive to third signals from said operator input means for modifying a third characteristic of signals input from said analog to digital converter for application to said digital to analog converter, said third means further comprising means for modifying a third characteristic of said image.

10. The audio sound signal modification system of claim 9 wherein said means for modifying a third characteristic comprises means for modifying the shade of at least one dot.

11. The audio sound signal modification system of claim 10 wherein said means for modifying the shade of at least one dot also comprises means for displaying said shade alphanumerically.

12. A method for modifying synthesized sound signals while providing an indication of the modification, comprising displaying an image having first, second and third visually different characteristics, receiving first, second and third different operator signals, modifying first, second and third audibly different characteristics of said sound signals in response to said first, second and third operator signals, respectively, and simultaneously modifying said first, second and third characteristics of said image, respectively.

13. The method of claim 12 wherein said step of modifying said first, second and third characteristics of said image comprises modifying the speed of motion of a portion of said image, the color of a portion of said image, and the shade of a portion of said image, respectively.

14. The method of claim 12 wherein said step of modifying said first, second and third characteristics of said sound signals comprises modifying the harmonic amplitude of said sound signals.

15. The method of claim 12 wherein said step of modifying said first, second and third characteristics of said sound signals comprises modifying the harmonic content of said sound signals.

16. The method of claim 12 wherein said step of modifying said first, second and third characteristics of said sound signals comprises modifying the ratio of harmonic components of said sound signals.

* * * * *